US010305201B2

(12) United States Patent
Hamada

(10) Patent No.: US 10,305,201 B2
(45) Date of Patent: May 28, 2019

(54) TERMINAL, HOT-MELT MEMBER-EQUIPPED TERMINAL, TERMINAL-EQUIPPED WIRE AND METHOD FOR PRODUCING TERMINAL-EQUIPPED WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Kazuaki Hamada, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/735,679

(22) PCT Filed: May 30, 2016

(86) PCT No.: PCT/JP2016/065856
§ 371 (c)(1),
(2) Date: Dec. 12, 2017

(87) PCT Pub. No.: WO2016/203936
PCT Pub. Date: Dec. 22, 2016

(65) Prior Publication Data

US 2018/0366839 A1 Dec. 20, 2018

(30) Foreign Application Priority Data

Jun. 19, 2015 (JP) ..... 2015-123659

(51) Int. Cl.
*H01R 4/02* (2006.01)
*H01R 43/02* (2006.01)

(52) U.S. Cl.
CPC ..... *H01R 4/023* (2013.01); *H01R 4/02* (2013.01); *H01R 43/02* (2013.01)

(58) Field of Classification Search
CPC ..... H01R 4/02; H01R 4/021; H01R 4/023; H01R 4/022; H01R 43/023; H01R 4/187
See application file for complete search history.

(56) References Cited

U.S. PATENT DOCUMENTS 2,668,215 A * 2/1954 Duerkob ..... H01H 85/542 439/877
3,070,650 A * 12/1962 Stearns ..... H01R 12/61 174/88 R (Continued)

FOREIGN PATENT DOCUMENTS

JP 55-168975 12/1980
JP 64-14883 1/1989

(Continued)

OTHER PUBLICATIONS

International Search Report dated Aug. 9, 2016.

*Primary Examiner* — Briggitte R. Hammond
(74) *Attorney, Agent, or Firm* — Gerald E. Hespos; Michael J. Porco; Matthew T. Hespos

(57) ABSTRACT

A terminal (20) includes a bottom surface (23) and solder holding portions (25, 25). A solder member (30) is placed on the bottom surface (23) of the terminal (20) and the solder holding portions (25, 25) are deformed to hold the solder member (30) in place. A conductor (12) of a wire (11) is placed on solder member (30). The solder member (30) then is melted by heating to connect the conductor (12) of the wire (11) to the terminal (20).

8 Claims, 8 Drawing Sheets

(56) References Cited

U.S. PATENT DOCUMENTS

| | | | | |
|---|---|---|---|---|
| 5,025,554 | A * | 6/1991 | Dohi | H01R 43/048 29/860 |
| 5,725,400 | A * | 3/1998 | Morikawa | H01R 4/023 439/874 |
| 6,309,260 | B1 * | 10/2001 | Shannon | H01R 4/024 174/84 R |
| 2008/0188119 | A1 | 8/2008 | Okamura et al. | |
| 2010/0068933 | A1 * | 3/2010 | Ikegami | H01R 13/6471 439/607.05 |
| 2014/0273560 | A1 * | 9/2014 | Cawood | H01R 4/187 439/98 |
| 2015/0011116 | A1 * | 1/2015 | Ohnuma | H01R 4/185 439/519 |
| 2015/0229035 | A1 * | 8/2015 | Nakayama | H01R 4/024 174/74 R |

FOREIGN PATENT DOCUMENTS

| | | |
|---|---|---|
| JP | 1-89466 | 6/1989 |
| JP | 4-71173 | 3/1992 |
| JP | 2008-192420 | 8/2008 |
| JP | 2010-108736 | 5/2010 |

* cited by examiner

TERMINAL, HOT-MELT MEMBER-EQUIPPED TERMINAL, TERMINAL-EQUIPPED WIRE AND METHOD FOR PRODUCING TERMINAL-EQUIPPED WIRE

BACKGROUND

Field of the Invention

A terminal equipped wire and a method for producing a terminal equipped wire are disclosed in this specification.

Description of the Related Art

Japanese Unexamined Patent Publication No. 2008-192420 discloses a method for connecting a wire to a terminal. for the method disclosed in Japanese Unexamined Patent Publication No. 2008-192420 includes applying solder to an exposed core of a wire in advance, inserting the wire into a wire insertion hole of a connector body holding a male terminal and soldering the core on the male terminal using a soldering iron.

In soldering a wire, it is normally necessary to supply solder to a soldering iron from outside, but it is preferable to omit an operation of supplying the solder from outside since an operation of connecting the wire to a terminal can be simplified.

The present invention was completed based on the above situation and aims to simplify an operation of connecting a conductor of a wire to a terminal.

SUMMARY

A terminal of the present invention has a conductor of a wire connected by a hot-melt member that is melted by heating and includes a bottom surface on which the hot-melt member is placed and a melt member holding portion that holds the hot-melt member placed on the bottom surface.

A method for producing a terminal-equipped wire is such that a hot-melt member is melted to connect a conductor of a wire to a terminal including a bottom surface on which the hot-melt member is placed and a melt member holding portion that holds the hot-melt member with the hot-melt member held by the melt member holding portion.

According to the above configurations, it is sufficient to connect the conductor of the wire to the terminal by melting the hot-melt member held by the melt member holding portion by heating. Thus, even if the hot-melt member is not supplied from outside, the conductor of the wire can be connected to the terminal. Therefore, an operation of connecting the conductor of the wire to the terminal can be simplified.

A terminal-equipped wire of the present invention is formed by connecting a conductor of a wire to a terminal by melting a hot-melt member by heating. The terminal includes a bottom surface on which the hot-melt member is placed and a melt member holding portion that holds the hot-melt member placed on the bottom surface portion, and the hot-melt member is melted to connect the conductor to the terminal. According to this configuration, the hot-melt member held by the melt member holding portion is melted and the conductor of the wire is connected to the terminal. Thus, the conductor of the wire can be connected to the terminal even if the hot-melt member is not supplied from outside. Therefore, an operation of connecting the conductor of the wire to the terminal can be simplified.

The terminal may include two wire holding pieces disposed at both sides of the conductor with the conductor placed on the hot-melt member.

In the case of connecting the wire to the terminal, a connection failure due to the spread of the conductor during soldering or the like is concerned unless a preliminary process such as preliminary soldering is performed. On the other hand, if the preliminary process is performed, there is a problem of not only increasing man-hours, but also taking time and labor for a process management (solder weighing, application of the flux, process time, etc.) and the like. According to this configuration, the wire holding pieces disposed at the sides of the conductor that has been placed on the hot-melt member suppresses the spread of the wire. Thus, it is possible to suppress a connection failure when connecting the conductor of the wire to the terminal while reducing a preliminary process.

A hot-melt member-equipped terminal includes the above terminal and the hot-melt member to be held by the melt member holding portion.

According to the invention, it is possible to simplify an operation of connecting a conductor of a wire to a terminal.

DETAILED DESCRIPTION

A terminal-equipped wire 10 of one embodiment is described with reference to FIGS. 1 to 11.

Figure 1:
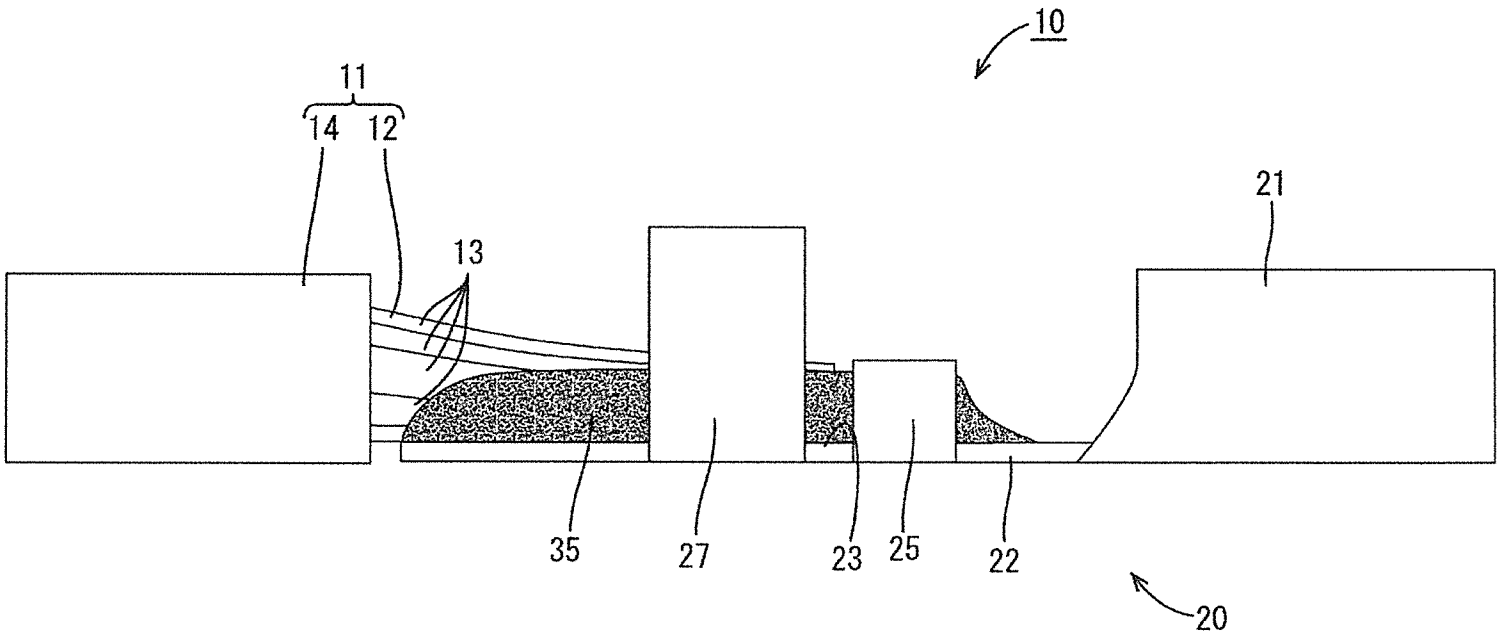
FIG. 1 is a side view showing a terminal-equipped wire of one embodiment.

A terminal 20 of the terminal-equipped wire 10 of the first embodiment can be, for example, mounted into a communication connector to be mounted into a vehicle such as an automotive vehicle. In the following description, upper and lower sides of FIG. 1 are referred to as upper and lower sides concerning a vertical direction, and right and left sides of FIG. 1 are referred to as front and rear sides concerning a front-rear direction.

(Terminal-Equipped Wire 10)

The terminal-equipped wire 10 includes a wire 11 and the terminal 20 to be soldered and connected to the wire 11 using solder 35 (solder 35 is in a state solidified after a solder member 30 to be described later is melted by heating). The wire 11 is such that a conductor 12 is covered around with an insulation coating 14 (insulation layer). The conductor 12 is formed by twisting metal stands 13, for example, made of copper, copper alloy, aluminum, aluminum alloy or the like. The insulation coating is stripped to expose the conductor 12 at an end part of the wire 11.

(Terminal 20)

The terminal 20 includes a connecting portion 21 to be connected to a mating terminal (not shown), a bottom plate 22 extending rearwardly of the connecting portion 21, two solder holding portions 25, 25 (an example of a "melting member holding portion") rising from side edges of the bottom plate 22 and two wire holding pieces 27, 27 rising from the side edges of the bottom plate 22 behind the solder holding portions 25.

The connecting portion 21 is box-shaped and includes an unillustrated resilient contact piece to be brought into contact with a mating male terminal inside. The bottom plate 22 is connected to a bottom plate of the connecting portion 21 and is a flat plate extending rearward of the connecting portion 21 while having a substantially constant width. The upper surface of the bottom plate 22 serves as a flat bottom surface 23 on which the solder member is placed as shown in FIG. 2.

Figure 6:
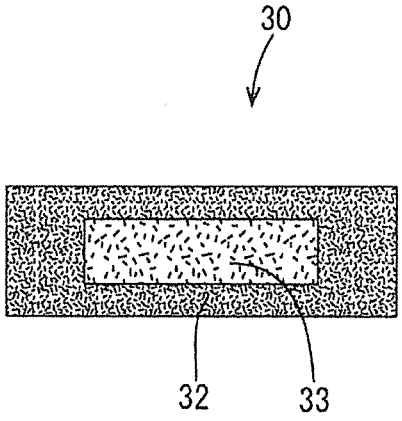
FIG. 6 is a section showing the solder member.
Figure 7:
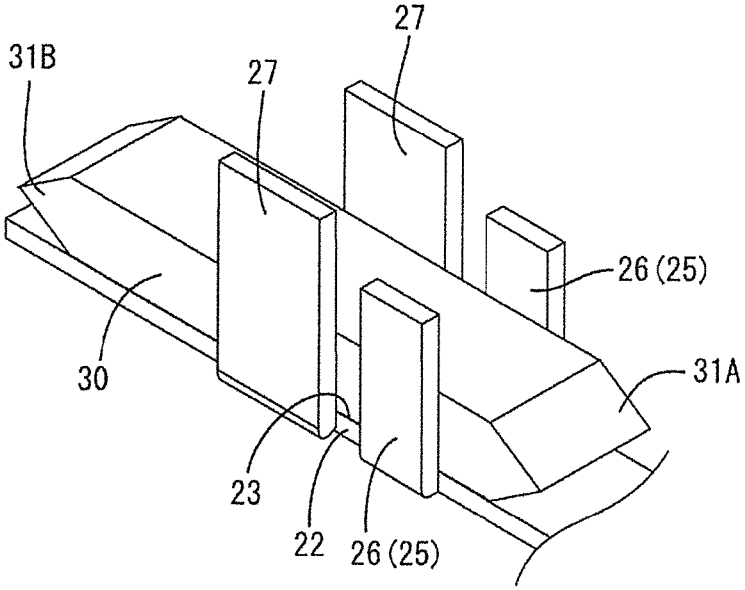
FIG. 7 is a perspective view showing a state where the solder member is placed on a bottom surface portion of the terminal before the solder member is held.

The solder 30 (an example of a "hot-melt member") is long in the front-rear direction, has a rectangular cross-section and a width substantially equal to that of the bottom plate 22 and is thicker than the bottom plate 22. Front and rear end parts of the solder 30 have upper and lower surface sides obliquely cut to form tapered portions 31A, 31B. A constant thickness part in the front end part of the solder 30 is disposed before the solder holding portions 25, 25 and a constant thickness part in the rear end is disposed behind the wire holding pieces 27, 27. The solder 30 is, for example, lead-free solder and, as shown in FIG. 6, flux 33 is included inside a body 32 made of tin, zinc, aluminum, indium and the like.

The solder 30 can be, for example, manufactured by processing a wire solder (including flux inside). Specifically, a wire solder having a circular cross-section is pressed by a die to be molded into a plate having a flat cross-section and upper and lower surfaces are made flat. The wire solder formed into a flat plate shape is cut to a predetermined length by a cutting blade, and front and rear end parts are shaped by being tapered. Note that the front and rear end parts of the solder 30 may be sealed so that the flux 33 does not leak out.

Figure 2:
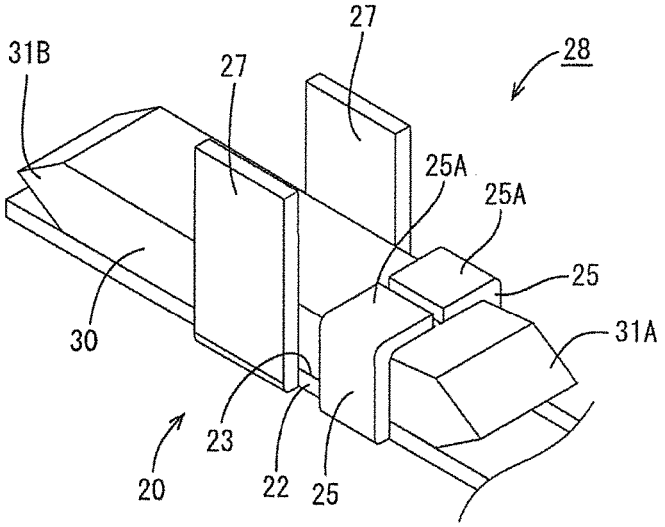
FIG. 2 is a partial perspective view showing a state where a solder member is held by solder holding portions.
Figure 3:
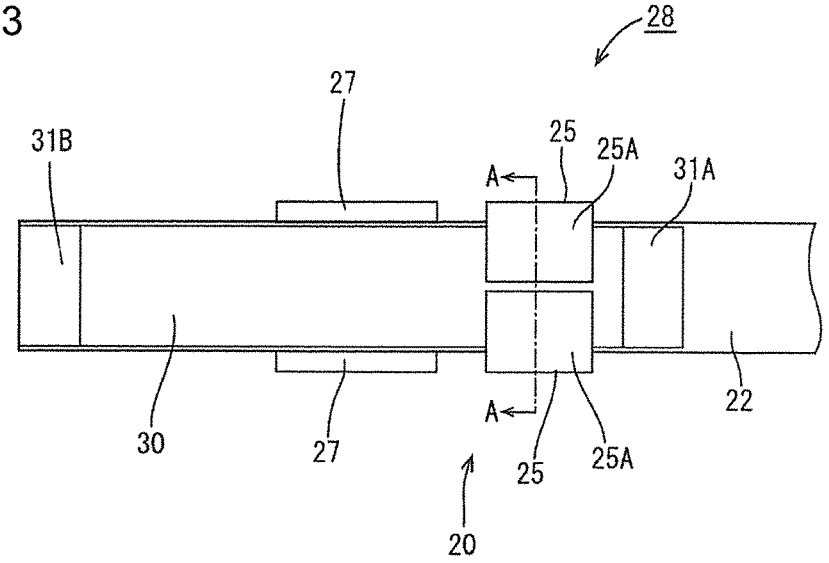
FIG. 3 is a partial plan view showing the state where the soldering member is held by the solder holding portions.
Figure 4:
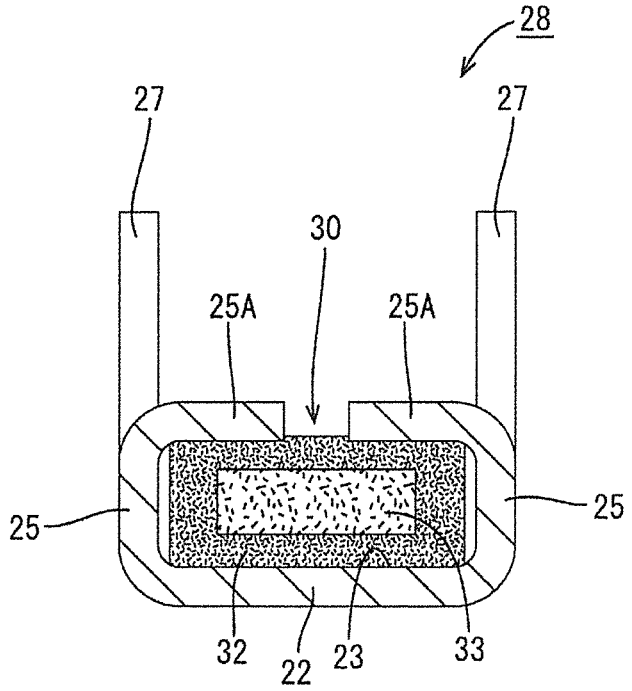
FIG. 4 is a section along A-A of FIG. 3.
Figure 5:
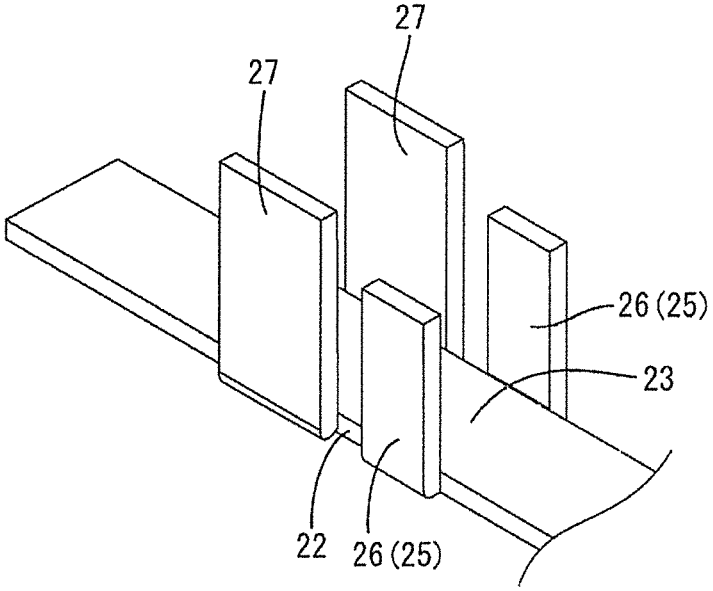
FIG. 5 is a partial perspective view of a terminal before the solder member is held.

As shown in FIG. 2, the two solder holding portions 25, 25 are for fixing the solder 30 placed on the bottom surface 23 to the bottom plate 22 by being crimped, and are both L-shaped. More specifically, the solder holding portions 25, 25 stand up from both side edges of the bottom plate 22, tip sides thereof are bent in at a right angle at a predetermined height to serve as pressing portions 25A, 25A for pressing the solder member 30 down. The solder holding portions 25, 25 are rising pieces 26, 26 in the form of plates rising up from the side edges of the bottom plate 22, as shown in FIG. 5, before holding the solder 30, and the pressing portions 25A, 25A of the solder holding portions 25, 25 bite into the upper surface of the solder 30, and the solder 30 is sandwiched between the pressing portions 25A, 25A and the bottom plate 22, as shown in FIG. 4, by bending the rising pieces 26, 26 at a right angle with the solder 30 placed on the bottom plate 22. When the solder 30 is held by the solder holding portions 25, 25, a solder-equipped terminal 28 (an example of a "hot-melt member-equipped terminal") is formed.

The wire holding pieces 27, 27 are in the form of flat plates, extend up perpendicular to the bottom plate 22 and spaced apart behind the solder holding portions 25, 25. Widths (dimensions in the front-rear direction) of the wire holding pieces 27, 27 are larger than widths (dimensions in the front-rear direction) of the solder holding portions 25, 25.

Figure 8:
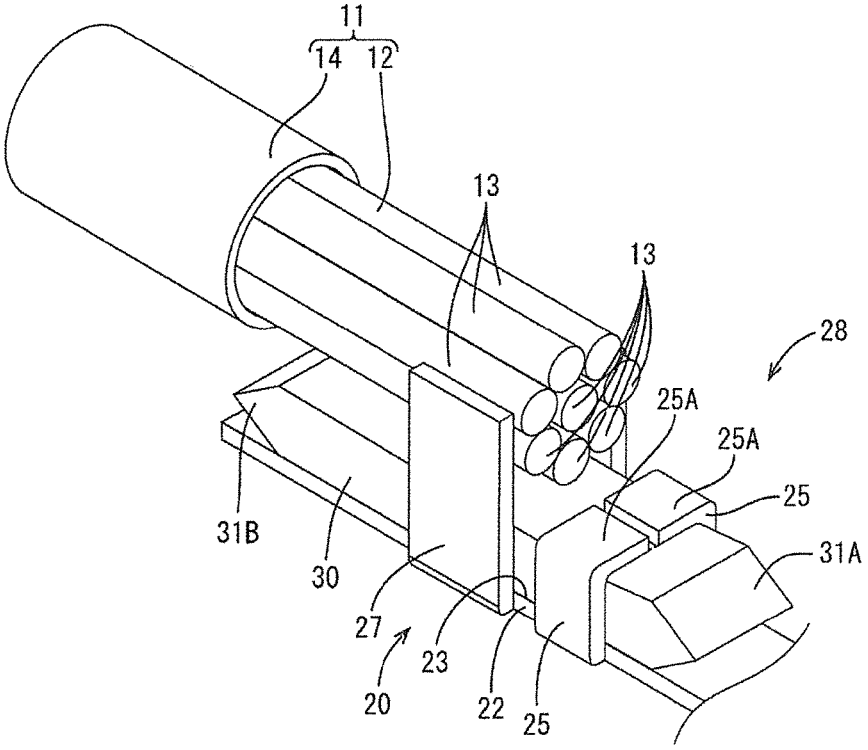
FIG. 8 is a perspective view showing a state where a conductor of a wire is placed on the solder member held by the solder holding portions.

Heights of the wire holding pieces 27, 27 are set such that the conductor 12 is inserted between the two wire holding pieces 27, 27 when the conductor 12 of the wire 11 is placed on the solder 30, as shown in FIG. 8. In this embodiment, the upper end of each wire holding piece 27 is slightly higher than a vertically middle part of the conductor 12.

Figure 9:
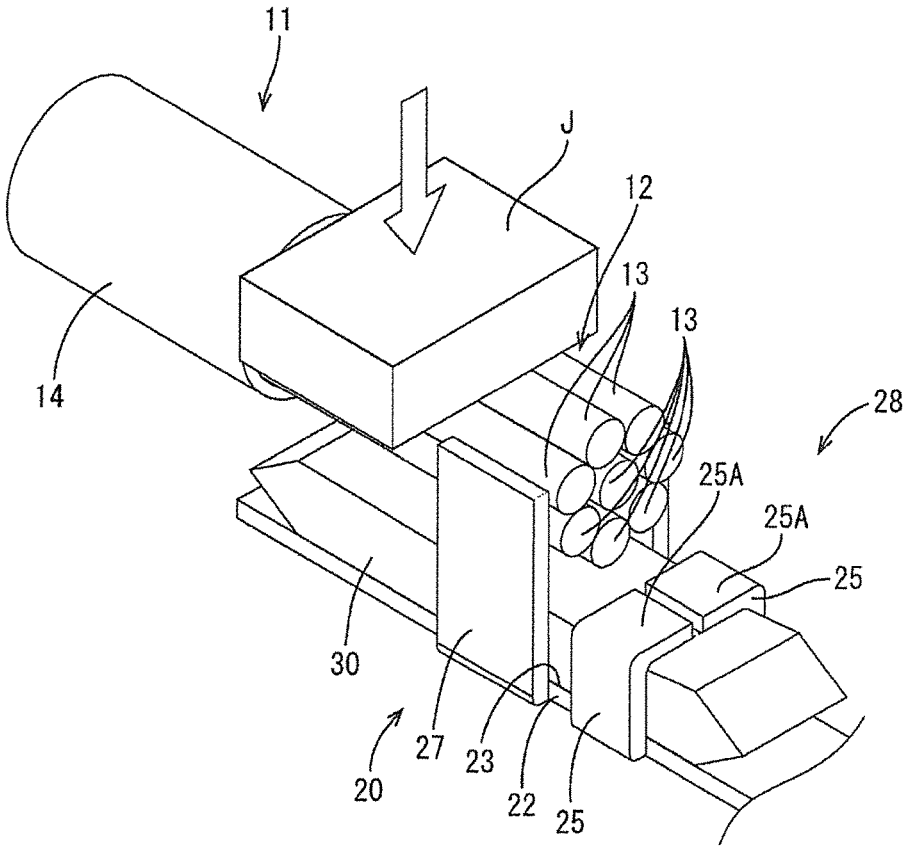
FIG. 9 is a perspective view showing a heating process using a heating tool from the state of FIG. 8.
Figure 10:
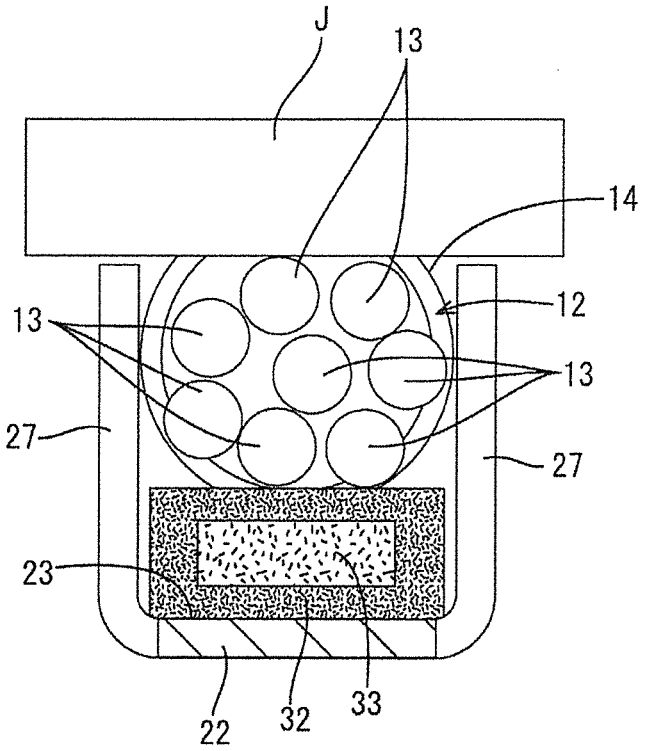
FIG. 10 is a section at the position of the solder member in the heating process using the heating tool.
Figure 11:
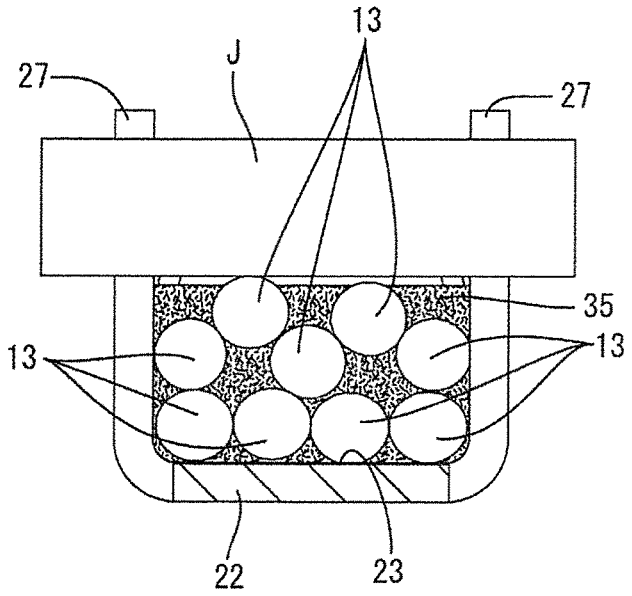
FIG. 11 is a section showing a state where the solder member is melted and solder is infiltrated between metal strands of the conductor.

A method for producing the terminal equipped wire 10 is described. A leading end part of the conductor 12 of the wire 11 is inserted between the two wire holding pieces 27, 27 of the solder-equipped terminal 28 and the conductor 12 is placed on the solder 30 (FIG. 8). Subsequently, a heating tool J is pressed down onto the conductor 12 (FIG. 9). At this time, the metal strands 13 are going to spread laterally by the conductor 12 being pressed down, but the spread of the metal strands 13 is suppressed since the wire holding pieces 27, 27 are disposed at left and right sides of the conductor 12 (FIG. 10). Heat of the heating tool J that is transferred to the conductor 12 is transferred further from the conductor 12 to the solder 30. Thus, the solder 30 is melted into a liquid form. Thus, the conductor 12 sinks into the melted solder, and the metal strands 13 of the conductor 12 come into contact with the bottom surface 23 of the terminal 20 (FIG. 11). When the heating of the heating tool J is stopped, the melted solder is solidified and becomes the solder 35 for electrically connecting the conductor 12 and the terminal 20 by soldering (FIG. 1). In this way, the terminal equipped wire 10 in which the conductor 12 of the wire 11 and the terminal 20 are soldered and connected is formed.

According to this embodiment, it is sufficient to connect the conductor 12 of the wire 11 to the terminal 20 by heating and melting the solder 30 (hot-melt member) held by the solder holding portions 25, 25 (melt member holding portion). Thus, even if solder is not supplied from outside, the conductor 12 of the wire 11 can be connected to the terminal 20. Therefore, an operation of connecting the conductor 12 of the wire 11 to the terminal 20 can be simplified.

Further, the two wire holding pieces 27, 27 are disposed at both sides of the conductor 12 with the conductor 12 placed on the solder 30.

In the case of connecting the wire 11 to the terminal 20, a connection failure due to the spread of the conductor 12 during soldering or the like is concerned, unless a preliminary process, such as preliminary soldering, is performed. On the other hand, if the preliminary process is performed, there is a problem of not only increasing man-hours, but also taking time and labor for a process management (solder weighing, application of the flux 33, process time, etc.) and the like. According to this embodiment, since the spread of the wire 11 can be suppressed by the wire holding pieces 27, 27 disposed at the both sides of the conductor 12 with the conductor 12 placed on the solder 30, it is possible to suppress a connection failure in connecting the conductor 12 of the wire 11 to the terminal 20 while reducing a preliminary process.

The invention is not limited to the above described and illustrated embodiment. For example, the following embodiments also are included in the scope of the invention.

Figure 12:
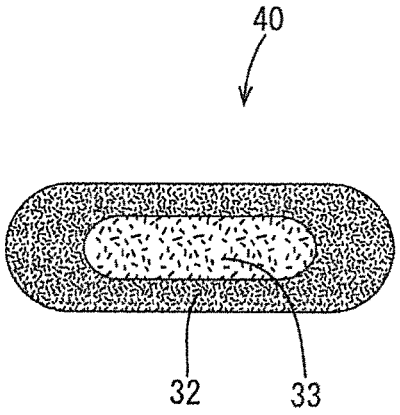
FIG. 12 is a section showing a solder member of another embodiment.

The shape of the solder 30 is not limited to the one having a rectangular cross-section and can be changed to various shapes. For example, a solder member may have a laterally long elliptical cross-section as shown in FIG. 12.

Although the solder 30 is used as the hot-melt member, there is no limitation to a solid such as the solder 30 and the hot-melt member may be a mixture of a solid (solid phase) and a liquid (liquid phase) like cream solder.

Although the terminal 20 is a female terminal, there is no limitation to this and a male terminal in which a connecting portion to a mating terminal is formed by a male tab may be employed.

Although the hot-melt member is the solder member 30, there is no limitation to this. For example, the wire may be brazed to the terminal 20, using a brazing material as the hot-melt member.

Although the conductor 12 is a twisted wire, it may not be a twisted wire. Further, the conductor 12 may be a single-core wire.

Although the solder holding portions 25, 25 are provided, there is no limitation to this. For example, one solder holding portion may be provided.

The shape of the solder holding portions 25, 25 is not limited to the shape of the above embodiment at least as long as the solder can be held in position. For example, the solder holding portions 25, 25 may be pins (bars) rising from the bottom plate 22 and the solder member 30 may be provided with recesses, into which the pins are fit, so that the solder member is held in position.

Although the flux 33 is included inside the solder (30, 40), the flux 33 may not be included.

LIST OF REFERENCE SIGNS

10: terminal-equipped wire
11: wire
12: conductor
20: terminal
23: bottom surface
25, 25: solder holding portion (melt member holding portion)
27, 27: wire holding piece
28: solder-equipped terminal (hot-melt member-equipped terminal)
30, 40: solder member (hot-melt member)

The invention claimed is:

1. A terminal, comprising:

a bottom plate having opposite front and rear ends, opposite first and second sides and a top surface;

a connecting portion at the front end and configured for connection to a mating terminal;

at least one wire holding piece extending from the bottom plate at a position between the connecting portion and the rear end;

a hot-melt member on the top surface of the bottom plate and extending at least from a position aligned with the at least one wire holding piece to a position forward of the at least one wire holding piece; and a melt member holding portion extending from at least one of the first and second sides of the bottom plate at a position between the at least one wire holding piece and the connecting portion, the melt member holding portion being configured to hold the hot-melt member placed on the top surface of the bottom plate.

2. The terminal of claim 1, wherein the at least one wire holding piece comprises first and second wire holding pieces extending respectively from the opposite first and second sides of the bottom plate and configured to hold a conductor with the conductor placed on the hot-melt member.

3. A terminal-equipped wire, comprising:

the terminal of claim 1; and a wire having a conductor and an insulating coating surrounding at least part of the conductor, the conductor having an end and the insulating coating being removed from an area of the conductor adjacent the end, wherein the conductor is placed on the hot-melt member so that the end of the conductor is rearward of the melt member holding portion;

the at least one wire holding piece is deformed to hold the conductor on the hot-melt member placed on the tom surface of the bottom plate; and the hot-melt member is melted to connect the conductor to the terminal.

4. A method for producing a terminal-equipped wire, comprising: placing a hot-melt member on a bottom plate of a terminal that has a melt member holding portion; deforming the melt member holding portion to hold the hot-melt member on the bottom plate of the terminal; placing a conductor of a wire on the hot melt member; and melting the hot-melt member to connect the conductor of the wire to the terminal.

5. The terminal of claim 1, wherein the hot-melt member extends to a position forward of the melt member holding portion.

6. The terminal of claim 1, wherein the hot-melt member extends to a position between the melt member holding portion and the connecting portion.

7. The terminal of claim 1, wherein the melt member holding portion is crimped into engagement with the hot-melt member.

8. The terminal of claim 1, wherein the at least one wire holding piece comprises two wire holding pieces crimped into engagement with the conductor.

* * * * *